United States Patent [19]

Rausing

[11] 4,411,370

[45] Oct. 25, 1983

[54] OPENING ARRANGEMENT FOR CANS

[75] Inventor: Hans Rausing, Lund, Sweden

[73] Assignee: Tetra Pak Developpement SA, Pully, Switzerland

[21] Appl. No.: 389,496

[22] Filed: Jun. 17, 1982

[30] Foreign Application Priority Data

Jun. 18, 1981 [SE] Sweden ..... 8103849

[51] Int. Cl.[3] ..... B65D 17/34

[52] U.S. Cl. ..... 220/269; 220/258; 220/268

[58] Field of Search ..... 220/266–273, 220/258; 229/7 R

[56] References Cited

U.S. PATENT DOCUMENTS

| | | | |
|---|---|---|---|
| 3,227,304 | 1/1966 | Asbury | 220/268 |
| 3,843,011 | 10/1974 | Perry | 220/269 |
| 3,958,717 | 5/1976 | Ellis | 220/268 |

*Primary Examiner*—George T. Hall

*Attorney, Agent, or Firm*—Burns, Doane, Swecker & Mathis

[57] ABSTRACT

An opening arrangement for cans which are made of sheet steel. The opening arrangement has two preferably U-shaped punched lines provided in the lid of the can. The punched lines wholly penetrate the can lid (2) and form two opposing tongues, which are separated by a narrow intermediate portion of the can lid. The punched out tongues as well as the intermediate portion are jointly covered by an inner cover strip fixed to the inside of the can lid which bridges over and seals the punched lines forming the tongues. On opening the can the two tongues are turned in unison, the intermediate portion acting as an axis of rotation, so that the tongues are placed at an angle and an opening in the lid is established.

12 Claims, 4 Drawing Figures

OPENING ARRANGEMENT FOR CANS

BACKGROUND AND SUMMARY OF THE PRESENT INVENTION

The present invention relates generally to opening arrangements for packing containers. More specifically, the present invention relates to an opening arrangement for cans of the type having at least one plane end wall made of sheet steel.

Metal cans have been used for a long time for the packing of liquid goods and depending on the resistance of the metal such cans have been used frequently for the packing of pressurized goods, such as e.g. beer and carbonated beverages.

For a long time the predominant type of cans have been those made of sheet steel, but since sheet steel has appreciable tearing resistance, often at least one end plate or lid has been manufactured from aluminium which is a softer and weaker metal making possible an accurate punching out of weakening lines along which parts of the aluminium end plate can be torn. A large number of such tearable openings in aluminium lids have been designed and the best known are probably the so-called "ring openers" which consist of a portion punched in the lid along a weakening line and a pull-ring which is riveted to the narrower part of the portion. When the said pull-ring is raised, a part of the punched out portion is torn, whereupon the remaining parts of the weakening line can be broken by pulling the pull-ring upwards.

It is one of the disadvantages of this design that it is inappropriate to mix together aluminium and steel in one and the same package, since in such a case the drum cannot be used as scrap metal, unless the aluminium parts are separated. Such a separation of the aluminium lid from the steel drum, however, is impossible economically. A known solution of the problem consists in manufacturing a drum wholly from sheet steel with a hole being provided in the sheet steel lid. Into the hole a cap of plastic material can then be inserted, and since the plastic material can easily be burnt, the remaining drum may be used as scrap metal in the manufacture of steel.

Such a solution is relatively expensive, though, and a clear need exists for a simple and inexpensive opening arrangement on a can which is completely made of sheet steel. A solution of this problem is provided in accordance with the present invention in which two tongues are provided in a steel can lid.

Each of the tongues is delimited partly by a preferably U-shaped punched line along which the lid is fully punched through and partly by a straight base line imagined between the end points of the U-shaped punched line along which the tongues are connected with the sheet steel material in the lid. The base lines of the two tongues are of substantially the same size and are located parallel with and close to one another in such a manner that a narrow portion of the end plate is formed between the two tongues.

BRIEF DESCRIPTION OF THE DRAWINGS

A preferred embodiment of the invention will be described in the following with reference to the attached schematic drawings, wherein.

DETAILED DESCRIPTION OF THE PREFERRED EMBODIMENTS

Figure 1:
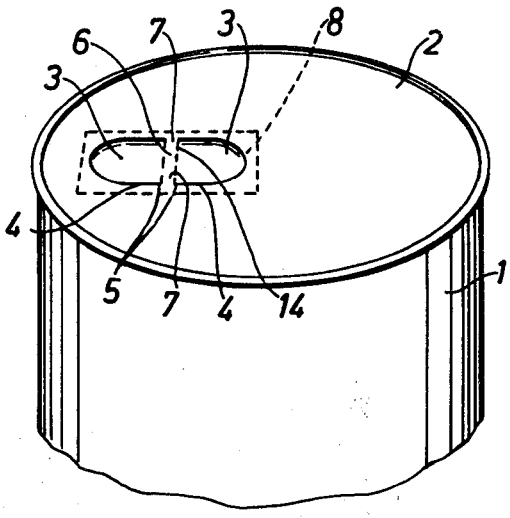
FIG. 1 is a perspective view of the upper part of a can provided with the opening arrangement in accordance with the invention.

It is assumed in all the figures that the can or container shown is manufactured from sheet steel and for the sake of simplicity it shall be assumed that the can is of the commonly occurring type which consists of a circular-cylindrical shell 1 at the end of which are beaded lids or end walls 2.

The plane lid or end wall 2 of the can 1 which is made of sheet steel includes two opposing tongues 3 which are formed by punched lines 4 completely perforating the lid, whose end points 5 are situated in pairs opposite one another, a portion of the lid 2 being formed between the tongues 3 which portion is designated by numeral 6. The portion 6 is delimited by the imaginary base lines 14 of the tongues 3 and the end points 5 of the punched lines 4, with the end points of the portion 6 being designated by the numeral 7.

The tongues 3 as well as the portion 6 in between are covered in a tight manner along the inside of the lid or end wall 2 by a cover strip 8 of plastic material. To ensure that the cover strip 8 seals against the inside of the end wall 2 it has to be varnished with a suitable fixing varnish, which, however, does not bring about any major inconvenience, since a metal can has to be provided with a protective layer of varnish along its inside as otherwise the contents acquire a metallic taste. The coverstrip will thus in a tight manner bridge the thin cracks which are formed by the perforation of the punched lines 4 and to a certain degree fix the tongues to the plane of the end walls 2.

Owing to the tongues 3 being approximately of the same area and of the same length and being placed opposite each other on either side of the narrow portion 6, the pressure in the can 1 will exercise the same effect on both the tongues. With the forces upon the tongues being balanced out, a spontaneous breaking of either of the tongues is prevented, which could happen if only one tongue 3 were punched out in the lid 2.

It is a precondition for such a balancing of the forces upon the tongues, however that the intermediate portion 6 or rather the parts 7 of the lid 2 which are situated between the end points 5 of the punched lines 4 are dimensioned so that they can function in pivotlike manner so that the forces upon the tongues 3 can be transmitted to one another with the portion 6 as a common axis of rotation for the tongues.

Any folding up of the tongues 3 along the base lines 14 of the tongues requires an appreciable force, since the lid 2 is manufactured from sheet steel on the other hand, a "seewsaw-like" rotating motion of the tongues about the axis of rotation 6 can be carried out with considerably less force, since the narrow connecting portions 7 between the tongues 3 and the lid 2 can be easily deformed.

Figure 2:
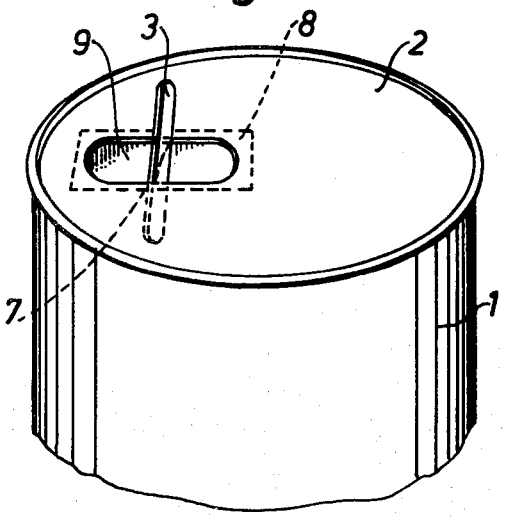
FIG. 2 is a perspective view of the can of FIG. 1 after the opening arrangement has been torn.
Figure 3:
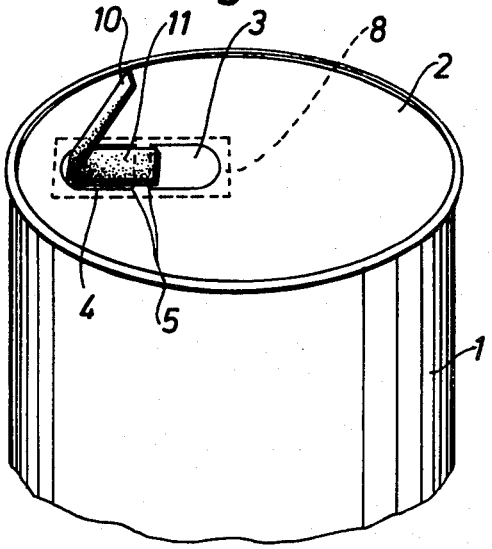
FIG. 3 is a perspective view of the opening arrangement of FIG. 1 provided with a pull-lug.

In FIG. 2 is can be seen how the package has been opened in that a force applied from the outside of the can onto either of the lugs 3 on the one hand has caused the connecting portion 7 to be deformed, and on the other hand has caused the cover strip 8 to break along the punched lines 4. In this way, the tongues can in a common rotating motion, i.e. in unison, be placed at an angle in the manner as shown in FIG. 2 with, an emptying hole 9 being formed in the lid or end wall 2 of the package.

If it is desired to remove the tongues 3 completely, this can be readily achieved by moving the projecting tongue 3 to and fro in such a manner that the steel material is caused to break owing to fatigue. Thereupon the tongues 3 together with the intermediate portion 6 can be removed from the emptying opening 9.

A simple method to bring about opening is to press down with a finger or with some object either of the tongues 3 into the can, which will cause the opposite tongue to be raised up. A certain amount of caution will have to be observed, however, since the punched edge 4 may be sharp. It is also quite possible to reclose the can by rotating the tongues 3 back to their original position.

If it is not desired to open the can by pressing either of the tongues with a finger or with some object, it is possible instead to attach a pull-strip 11 to one of the tongues 3 which is fixed with good adhesion to the tongue 3. To obtain the maximum possible turning moment on the portion 6, the pull-strip should at the outer part of the tongue 3 change into a free grip-piece 10 by which the tongues 3 can be set at an angle through deformation of the end zones 7 of the intermediate portion 6.

Figure 4:
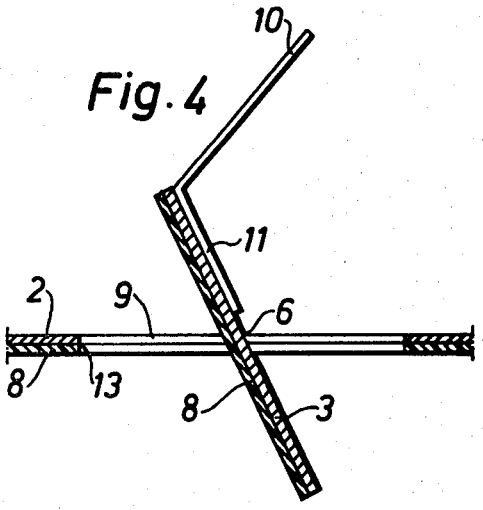
FIG. 4 is a cross-sectional view through an opened can end plate.

This embodiment of the invention is illustrated in FIG. 4 where the tongues 3 are shown in open position, set at an angle against the end plate 2. As is evident from FIG. 4, the end plate or lid 2 is provided on its inside with a cover strip 8 which is sealed against a thermoplastic varnish layer applied to the inside of the lid 2 so as to obtain a good sealing adhesion between the cover strip 8 and the inside of the lid 2. Similarly the pull-strip 11 is sealed with good adhesion to one of the tongues 3, while a free grip-lug 10 projects from the front part of the pull-tongue 3. When the pull-tongue 10 is seized between the fingers and pulled upwards, a tensile force is applied to the front part of the tongue 3 which brings about a torsion stress in the end zones 7 of the portion 6. The tensile force in the free grip-part 10 endeavors to set the tongues 3 at an angle, as a result of which the cover strip 8 is subjected to a stress in the region of the punched lines 4. This stress is so great that the cover strip 8 breaks along the extension of the punched lines, whereupon the tongues 3 can be set at an angle in the manner as shown in FIG. 4 and a pouring opening 9 is established.

A more complicated and consequently inferior method of achieving the sealing of the punched out cut lines 4 includes filling out the punched lines 4 with a thermoplastic material, e.g. of the hot melt type. Owing to the small surface of the punched lines 4, the pressure from the pressurized contents on such a material introduced into the punched lines will not affect the material to such an extent as to press it out through the punched out channels.

It has been shown that the opening arrangement in accordance with the invention solves a problem, which has been unsolved for a long time, in an inexpensive and effective manner and it should be possible to use the opening arrangement on other packages than so-called beer cans for which, however, it is intended first and foremost. It is also possible within the scope of the concept of the invention to design the extension of the punched lines 4 and hence the appearance of the tongues in a different manner, and it is not necessary for the tongues 3 to be of identical appearance, while it is desirable that the forces on the tongues and the turning moments acting on the intermediate portion 6 should be balanced, so that no kind of "spontaneous opening" of the opening arrangement occurs when the pressure in the package becomes too great.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. An opening arrangement for packing containers of the type having at least one plane end wall, comprising:

a first tongue provided in the end wall of the packing container; and a second tongue provided in the end wall of the packing container, each of said first and second tongues being partly delimited by a punched line and partly delimited by a straight base line between end points of said punched line, each of said tongues being connected with the end wall along a respective base line, said first and second tongues being positioned such that said respective base lines are adjacent and parallel to one another, a relatively narrow intermediate portion of said end wall being located between said base lines of said two tongues.

2. The opening arrangement of claim 1 wherein said tongues are U-shaped and of substantially the same size and wherein said punched lines partly delimiting said tongues are fully punched through said end wall which is made of a sheet steel plate.

3. An opening arrangement for packing containers having at least one plane end wall made of sheet steel, comprising:

a first U-shaped tongue punched through the end wall;

a second U-shaped tongue punched through the end wall and located adjacent said first tongue, each tongue having a straight base line defined between end points of said respective U-shaped tongue, said base lines paralleling each other and defining between them a relatively narrow intermediate portion of the end wall, both of said tongues and said intermediate portion being pivotable in unison with respect to the end wall around end portions of said intermediate portion; and a cover strip fixed to the inner surface of the end wall and covering said intermediate strip and said tongues to seal said intermediate strip and said tongues before they are pivoted to open the container.

4. The opening arrangement of claim 1, wherein the two tongues are substantially of the same area and length.

5. The opening arrangement of claim 2, wherein the two tongues, as well as the intermediate portion, are covered in a tight manner by a cover strip of a plastic material fixed to the inner surface of said end wall.

6. The opening arrangement of claim 2, wherein said intermediate portion is of a width considerably less than the length of the intermediate portion, and wherein upon opening the container both tongues and the intermediate portion are pivoted in unison around the ends of the intermediate portion which ends are located between opposed end points of the two U-shaped punched lines.

7. The opening arrangement of claim 1 or 3, further comprising a pull-strip attached to the outside surface of the end wall by which one tongue can be raised up while at the same time deforming and turning the intermediate portion between the tongues.

8. The opening arrangement of claim 7, wherein the pull-strip is fixed along one of the tongues and includes a grip-part situated on the outer part of the tongue.

9. The opening arrangement of claim 5, wherein when said tongues are pivotable around said intermediate portion, said tongues being displaced in unison at the same time and in the same plane, said tongues being set at an angle relative to the surface of the end wall while the inner cover strip is broken up along the U-shaped punched lines and an emptying opening is formed in said end wall.

10. The opening arrangement of claim 4, wherein the container holds pressurized contents which act upon said tongues, a pressure of said pressurized contents being balanced on said tongues so that no turning movement which may be caused by the pressure affects said tongues and said intermediate portion.

11. The opening arrangement of claim 5, wherein the cover strip is supported by the tongues.

12. The opening arrangement of claim 9, wherein the cover strip, at least on the tongue which will be lifted up from the plane of the end wall, is perforated or punched along a line close to the inner edge of the tongue.

* * * * *